US007467987B2

(12) United States Patent
Khalaf

(10) Patent No.: US 7,467,987 B2
(45) Date of Patent: Dec. 23, 2008

(54) TREATMENT BRASSIERE AND METHOD OF PRODUCING SAME

(76) Inventor: Naila K. Khalaf, 5142 Los Bonitas Way, Los Angeles, CA (US) 90027

( * ) Notice: Subject to any disclaimer, the term of this patent is extended or adjusted under 35 U.S.C. 154(b) by 713 days.

(21) Appl. No.: 10/829,089

(22) Filed: Apr. 20, 2004

(65) Prior Publication Data

US 2005/0229935 A1 Oct. 20, 2005

(51) Int. Cl.
*A41D 3/10* (2006.01)
*A41D 3/00* (2006.01)

(52) U.S. Cl. ..... 450/1; 450/92; 450/93; 450/37; 604/385.07; 424/402; 514/946; 514/947

(58) Field of Classification Search ..... 450/36, 450/37, 39, 192, 93; 602/55–57, 41–43; 604/385.07, 385.03, 385.14, 363, 364, 304; 424/402, 411, 412, 419, 420, 400; 514/946, 514/947

See application file for complete search history.

(56) References Cited

U.S. PATENT DOCUMENTS 2,707,281 A * 5/1955 Barth ..... 450/39
2,797,415 A * 7/1957 Spanel et al. ..... 450/39
5,961,986 A * 10/1999 Killen ..... 424/400
7,008,409 B2 * 3/2006 Spiezio et al. ..... 604/385.07

* cited by examiner

*Primary Examiner*—Gloria Hale
(74) *Attorney, Agent, or Firm*—Raymond Y. Chan; David and Raymond Patent Firm

(57) ABSTRACT

A treatment brassiere includes a breasts-supporting garment and a treatment layer. The breast-supporting garment includes at least a breast support having an inner surface and a securing device for securing the breast support on a user that the inner surface of the breast support is contacting with the breast surface of the user. The treatment layer, which is made of a non-absorptive material with respect to a breast treatment, is fittingly provided on the inner surface of the breast support, wherein the treatment layer form as a treatment barrier between the breast surface of the user and the inner surface of the breasts-supporting garment for substantially keeping the breast treatment on the breast surface.

12 Claims, 3 Drawing Sheets

TREATMENT BRASSIERE AND METHOD OF PRODUCING SAME

BACKGROUND OF THE INVENTION

1. Field of Invention

The present invention relates to a brassiere and more particularly to a treatment brassiere for keeping a treatment on the breasts of the user, which comprises at least a treatment layer provided on an inner surface of the breast supports, so as to form a barrier between the inner surface of the breast support from a breast skin surface of the user, such that breast treatment can remain on the breast surface of the user for the breast surface to absorb.

2. Description of Related Arts

The breasts are a prominent sexual characteristic of the female gender. No doubt that the breast is an important organ in the female reproductive system, since the milk glands produces milk for feeding babies. They also act as an important attraction to the opposite gender.

Most female therefore are very conscious of their breasts. They are conscious about their shapes, the sizes, firmness, skin softness. One of the methods in which women enhance the appearance of their breasts is through wearing bras. The basic function of a bra is to hold the breasts against the force of gravity, better define the shape of the breasts and to protect the breasts from discomfort due to direct contacting with clothes.

However, as technology advances, many women now seek for other breast enhancement methods, such as applying breast conditioning lotion and going for breast augmentation or breast reduction surgery. Also, after other surgeries such as breast cancer operations or heart operations, the skin condition in the breast area has to be specially taken care of.

Many of these enhancement methods involve the application of creams or lotions. In the case of applying breast conditioning lotion, there are lotions such as breast firming lotions, skin softening lotions and breast enhancing lotions. In the case of surgeries, very often, lotions or medications are given to patients for transdermally applying onto the skin in the breast area. Such creams, lotions and medications are usually very expensive, due to their cosmetic or medical nature.

When such creams or lotions are applied to the skin in the breast area, most women will simply take for granted that the creams and lotions are fully absorbed by the skin. However, due to the fact that the breasts are covered up almost all the time by the bra or other garments, which usually are made of cotton, an absorptive material, most women will not realize that how much such creams are actually being absorbed by the material of the bra or clothing, instead of their breasts.

Not only will the absorption of such creams or lotions hinders the functions of such lotions or creams, money is also wasted without the women's knowing.

As a result, a product has to be developed to help such cream and lotions to perform their full functions and also reduce the lost of money due to absorption of such creams and lotions by bras or other garments.

SUMMARY OF THE PRESENT INVENTION

A main object of the present invention is to provide a treatment brassiere for keeping a treatment on the breast surface of the user, which comprising at least a treatment layer provided on an inner surface of the breast support, so as to form a barrier between the breast surface of the user and the inner surface of the breasts-supporting garment.

Another object of the present invention is to provide a treatment brassiere, wherein any breast treatment applied onto the breast skin surface of the user is not absorbed by a material of the breasts supporting garment, and remain on the skin surface of the user.

Another object of the present invention is to provide a treatment brassiere, wherein the treatment layer is integrally attached to the inner surface of the breast support, such that the treatment layer remain comfortably in place when the user wears the treatment brassiere.

Another object of the present invention is to provide a treatment brassiere, wherein the non-absorptive material of the treatment layers is soft and deformable, such that its shape changes according to a movement of the user, so as to provide maximum comfort to the user.

Another object of the present invention is to provide a treatment brassiere, wherein the non-absorptive material of the treatment layer is washable and durable, such that the user can easily clean and maintain the treatment brassiere.

Another object of the present invention is to provide a treatment brassiere, wherein the non-absorptive material of the treatment layer is not allergenic such that it will not irritate the breast skin of the user and will not cause allergy.

Another object of the present invention is to provide a treatment brassiere, wherein the non-absorptive material of the treatment layer is resistant to electricity and oxidation, such that the layers will not cause static electric shock to the user and will not break off due to oxidation.

Another object of the present invention is to provide a method of producing a treatment brassiere, wherein the treatment brassiere is turned inside out such that the inner surfaces are exposed in a convex manner, before the treatment solution is applied onto the inner surface of the breast support, such that the treatment solution is uniformly applied onto the inner surface of the breast support, so as to provide maximum comfort to the user.

Another object of the present invention is to provide a method of producing a treatment brassiere, wherein the method is applicable to brassieres of all sizes, such that the treatment brassiere can be provided for women of all sizes.

Another object of the present invention is to provide a method of producing a treatment brassiere, wherein the treatment layer is integrally formed on the inner concave surface of breast support, such that the treatment layer retains its position while the user can carry on with their daily work.

Another object of the present invention is to provide a method of producing a treatment brassiere, a drying agent is applied to the treatment layer so as to provide a smoother finish to the treatment layers.

Accordingly, in order to accomplish the above objects, the present invention provides a treatment brassiere for keeping a breast treatment on a breast surface of a user, comprising:

a breasts-supporting garment having at least a breast support having an inner surface for contacting the breast surface of the user, and a securing means for securing the breast supports onto the user; and at least a treatment layer made of a non-absorptive material with respect to the treatment, fittingly provided on the inner surface of the breast support, wherein the treatment layer forms a treatment barrier between the breast surface of the user and the inner surface of the breasts-supporting garment, so as to keep the breast treatment on the breast surface of the user.

The present invention has an alternative embodiment, wherein the present invention provides a method of forming a treatment layer on a treatment brassiere, comprising the steps of:

(a) melting a predetermined amount of non-absorptive treatment material to form a treatment solution; and (b) applying the treatment solution on an inner surface of the breast support such that the treatment solution integrally forms the treatment layer on the inner surface of the treatment brassiere such that the treatment layer form as a treatment barrier between a breast surface of a user and the inner surface of the breasts-supporting garment for substantially keeping a breast treatment on the breast surface of the user.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
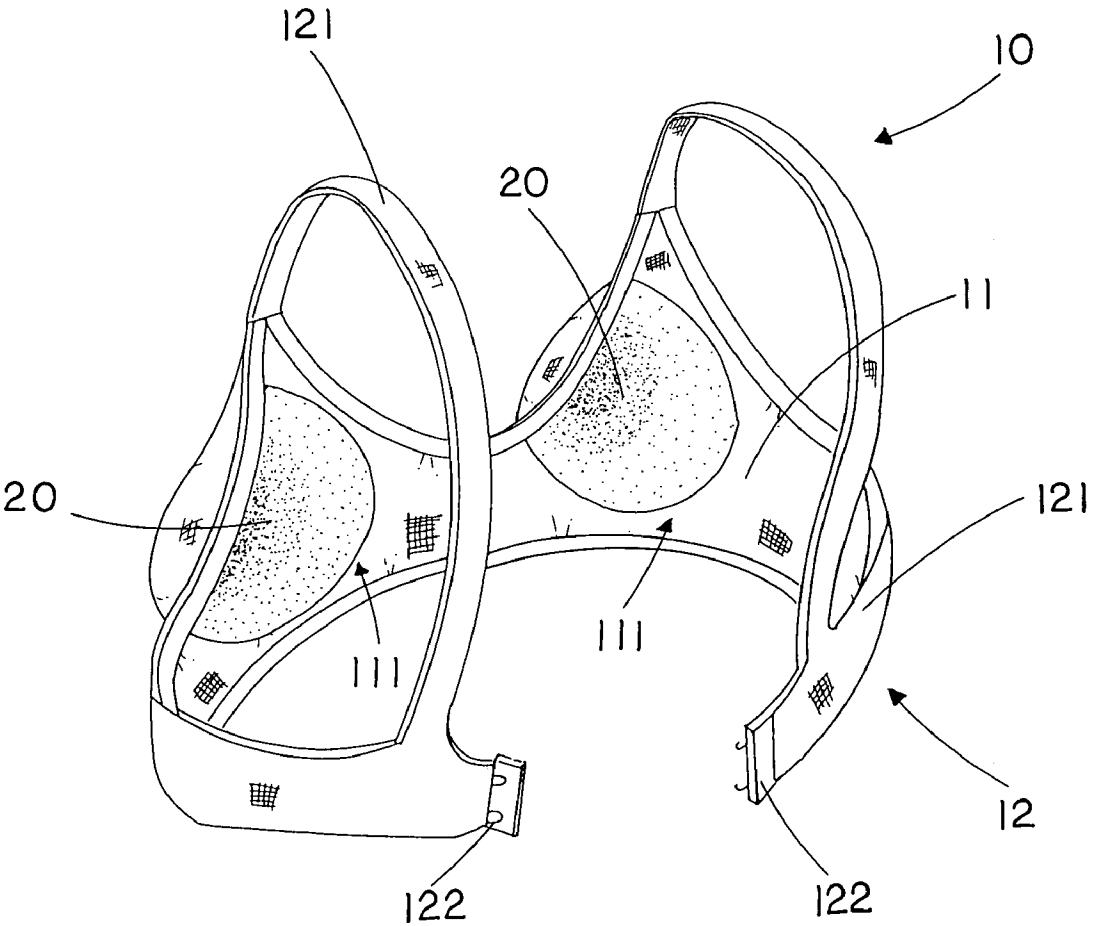
FIG. 1 is a perspective view of a treatment brassiere according to a preferred embodiment of the present invention.
Figure 2:
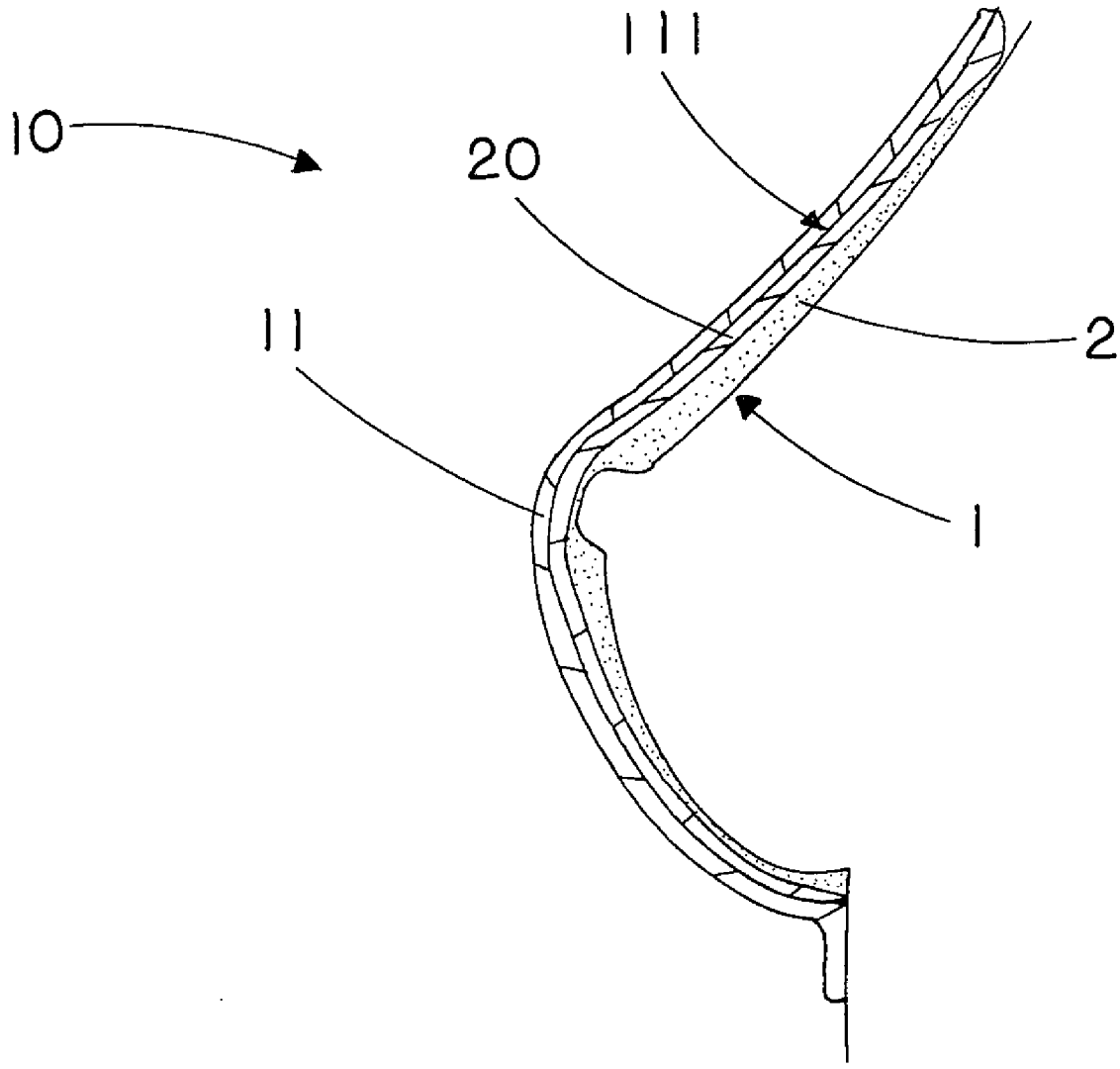
FIG. 2 is a cross-sectional view of the treatment brassiere according to the above preferred embodiment of the present invention being used by a user.

Referring to FIG. 1 and FIG. 2 of the drawings, a treatment brassiere according to a preferred embodiment of the present invention is illustrated, wherein the treatment brassiere, which is adapted for keeping a breast treatment 2 applied to the breast surface 1 of a user, comprises a breasts-supporting garment 10 and a treatment layer 20.

The breasts-supporting garment 10 has at least a breast support 11 and a securing means 12 for securing the breast supports onto the user. Conventionally speaking, the breasts-supporting garment 10 has two breast supports 11 wherein the securing means 12 is extended from the two breast supports 11. Each of the breast supports 11 has an inner surface 111, wherein the inner surfaces 111 are the surfaces which face the breast surfaces 1 of a user such that when the user wears the treatment brassiere, the inner surfaces 111 of the breast supports are fittingly contacting with the breast surfaces 1 of the user respectively.

Each of the breast supports 11 covers at least a portion of the respective breast surface 1 of the user. The breast supports 11 are connected to the securing means 12 of the breasts-supporting garment 10 such that the breast supports 11 are secured on the user. According to a preferred embodiment of the present invention, the securing means 12 further comprises an enclosing means 122 for the breast support 11 to enclose a torso of the user. The enclosing means 122 includes, but not limited to, adhesive, elastic band, button, hook and eye fasteners.

Accordingly, the securing means 12 comprises a pair of shoulder straps 121 extended from the breast supports 11 respectively. The shoulder straps 121 enhance the breasts supporting ability of the breast supports 11. The securing means 12 secures the breast supports 11 on the user by holding the entire breasts-supporting garment 10 onto a torso area underneath the bust of the user. The pair of shoulder straps 121 provides a vertical pulling force on the breast supports 11 respectively against the breast support 11. As a result, the shoulder straps 121 pulls the breast supports 11 vertically to hold the breast supports 11 firming over the breast of the user. Furthermore, the shoulder straps 121 are preferred to be comprised of an elastic material, so as to enhance the vertical pulling force on the breast supports 11.

The treatment layer 20, which is made of non-absorptive material relative to the breast treatment 2, is integrally attached on the respective inner surface 111 of the breast support 11. The treatment layer 20 forms as a treatment barrier between a breast surface 1 of the user and the inner surface 111 of the breasts-supporting garment 10.

As the material of the treatment layer 20 is non-absorptive, lotions or medications as the breast treatment 2 applied to the breast surface 1 of the user are separated from the absorptive material of the breasts-supporting garment 10. After applying lotions or medications to the breast surface 1, the user can put on the treatment brassiere of the present invention to shield the lotions or medications away from other clothing, such that the lotions or medications remain on the breast surface 1 of the user, allowing the breast surface 1 to fully absorb the lotions or medications in time. By putting on the treatment brassiere, instead of loosing a large amount of lotions or medications to clothing, all the lotions or medications applied onto the breast surface 1 are fully utilized for treating the breast.

According to this preferred embodiment of the present invention, the treatment layer 20 is made of natural rubber. Natural rubbers have the properties of resistant to electricity, oxidation, impact, abrasion, tear and weathering. Latex, being the preferred natural rubber to be used in the present invention, is widely use in the surgical world, where it is famous for its durability, flexibility, insulation property, and not likely to cause allergy or irritation. Surgeons wear them for protection against contamination when treating patients. It is worth to mention that the treatment layer 20 is deformable with respect to the breast support 11 for fittingly contacting the breast surface 1 of the user.

As a result, when the treatment layers 20, which made up of such natural rubber, are provided on the inner surfaces 111 of the breast supports 11 respectively, the breast surface 1 of the user is shielded away from the inner surfaces 111 of the breast supports 11 by the treatment layers 20.

Referring to FIG. 2 of the drawings, any breast treatment 2 applied on the breast surface 1 of the user is shielded away from the inner surfaces 111 of the breast supports 11 by the treatment layers 20. Therefore, the breast treatment 2 remains on the breast surface 1 of the user.

It is worth to mention that the breast support 11 is shaped and sized to fit the shape and size of the breast of the user such that the curvature of inner surface 11 of the breast support 11 is corresponding to the curvature of the breast surface 1 of the user. When the treatment layer 20 is provided on the inner surface 111 of the breast support 11, the treatment layer 20 has a curvature corresponding with the curvature of breast surface 1 of the user for fittingly contacting with the breast surface 1 of the user so as to ensure the breast treatment 2 to be applied thereon. In other words, the curvature of the treatment layer 20 is corresponding to the curvature of the inner surface 111 of the breast support 11 such that when the treatment layer 20 contacts with the breast surface 1 of the user, the treatment layer 20 substantially enforces the breast treatment 2 on the breast surface 1 of the user.

Therefore, the flexibility and deformability provided by the material of the treatment layers 20 enables the treatment layers 20 to shape according to the movement of the user, so that no discomfort is caused to the user.

Due to the properties of the material of the treatment layer 20, not only can it provide the user experience with maximum comfort and total sense of security, the condition of the treatment layer 20 is also easy to maintain as the material is very durable and deformable, allowing the treatment layer 20 to move and shape according to the movement of the user, such that the treatment layer 20 remains fittingly attached to the breast surface 1 of the user.

In order to provide maximum comfort and sense of security to the user, the treatment layers 20 are integrally attached to the inner concave surfaces 111 respectively, such that the treatment layer 20 remains in a fixed position so that the treatment layer 20 forms as an inner side of the breast support 11 for supporting the breast of the user. Therefore, the user will not have to worry about the treatment layer 20 not being in position or falling off, causing embarrassment to the user.

According to the preferred embodiment of the present invention, the material of the breasts-supporting garment 10, especially the inner surface 111 is made of cotton. Even though other materials are also viable, the treatment layer 20 is better integrally attached to the inner surface 111 when the material of the inner surface 111 is cotton. Cotton, in general a more comfortable material for clothing due to its ability to absorb sweat and provide ventilation to the skin, when used as the material of the treatment brassiere provides better comfort to other areas of the user where the treatment brassiere covers.

Figure 3:
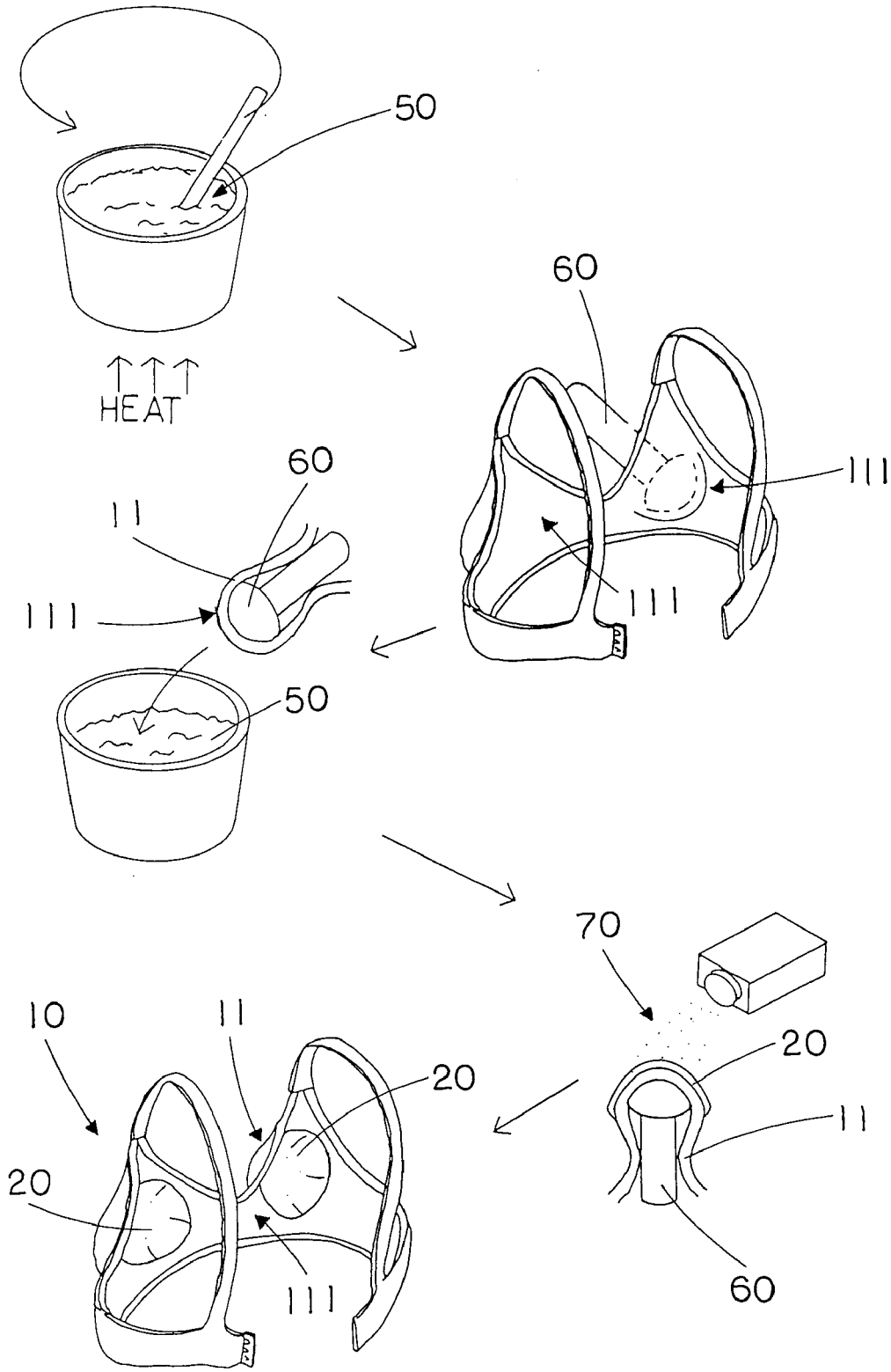
FIG. 3 is a flow diagram illustrating a method of producing a treatment brassiere according to an alternative embodiment of the present invention.

Referring to FIG. 3 of the drawings, the present invention further provides a method of forming the treatment layer 20 on the treatment brassiere, wherein the method comprises the following steps.

(1) Melt a predetermined amount of non-absorptive treatment material to form a treatment solution 50.

(2) Apply the treatment solution 50 on the inner surface 111 of the breast support 11 such that the treatment solution 50 integrally forms the treatment layer 20 on the inner surface 111 of the treatment brassiere such that the treatment layer 20 form as a treatment barrier between the breast surface 1 of the user and the inner surface 111 of the breasts-supporting garment 10 for substantially keeping the breast treatment 2 on the breast surface 1 of the user.

The non-absorptive material originally is in the form of solid. In order to apply to the inner surfaces 111, it has to be first melted to a liquid state. Although the non-absorptive material can be melted by many methods, it is best to be gradually melted by heat as shown in FIG. 3, with adequate stirring so that all the non-absorptive material is uniformly melted and burning avoided.

It is worth to mention that although it is preferred that the treatment solution 50 is evenly applied onto the inner surface 111 of the breast support 11, so as to form treatment layers 20 of uniform thickness, the treatment layer 20 can actually be designed to be of uneven thickness, providing special contours for the user.

The treatment solution 50 is applied onto the inner surfaces 111 through many different methods, including but not limited to brushing the treatment solution 50 onto the inner surfaces 111 or dipping the inner surfaces 111 into the treatment solution 50.

According to the preferred embodiment of the present invention, the method, in step (2), further comprises the following steps.

(2.1) Turn the treatment brassiere inside out that the inner surface 111 of the breast support 11 is exposed in a convex manner such that the treatment solution 20 is evenly applied on the inner surface 111 of the breast support 11.

(2.2) Dry the treatment solution 50 such that the treatment layer 20 is integrally formed on the inner surface 111 of the breast support 11.

(2.3) Turn breast support 11 of the treatment brassiere back to an original shape such that the treatment layer has a curvature corresponding with a curvature of the inner surface 111 of the breast support 11.

In step (2), the treatment solution 50 is applied onto the inner surface 111 of the breast support 11 by means of dipping the inner surfaces 111 of the breast support 11 into the treatment solution 50, as shown in FIG. 3. In addition, in order for the convenient and uniform applying of the treatment solution 50 onto the inner surfaces 111 of the breast support 11, the breast-supporting garment 10 is turned inside out in step (2.1) such that the inner surfaces are exposed in a convex manner.

As a result, when the inner surface 111 is dipped into the treatment solution 50 for a predetermined amount of time, a substantial amount of the treatment solution 50 will integrally attach onto the inner surface 111 of the breast support 11 to form the treatment layer 20.

Furthermore, if the breasts-supporting garment 10 is a collapsible type, the breast support 11 cannot retain the cup shape when lying flat. In order to help dipping the inner surface 111 of the breast support 11 into the treatment solution 50 when the breast support 11 is turned inside out, a convex mold 60 is placed at the outer surface of the breast support 11 to retain the shape of the inner surface 111 of the breast support 11 before the treatment solution 50 is applied on the inner surfaces 111 of the breast support 11.

As shown in FIG. 3, the convex mold 60 has a convex retention surface to contact with the outer surface of the breast support 11 so as to retain the shape of the inner surface 111 of the breast support 11 when the breast support 11 is folded inside out. When the inner surface 111 of the breast support 11 is exposed, the inner surface 111 of the breast support 11 is dipped into the treatment solution 50, such that the treatment solution 50 is integrally attached onto the inner surfaces 111 of the breast support 11.

The step of dipping the inner surface 111 of the breast support 11 into the treatment solution 50 provides the most uniform treatment layers 20 on the inner surface 111 respectively since it only involves a natural adhesion force between the treatment solution 50 and the material of the inner surface 111. Other methods such as brushing the treatment solution 50 onto the inner surface 111 of the breast support 11 may cause irregularity to the treatment layer 20.

After the treatment solution 50 is dried onto the inner surface 111 of the breast support 11, the method further comprises a step of applying a drying agent 70 to the treatment layer 20 to provide a smoother finish to the treatment layer 20, as well as to better dry the treatment layer 20. Accordingly, the drying agent 70 is talcum powder, which is essentially hydrous magnesium silicate. The application of the talcum powder to the treatment layer 20 provides a matt finish to the treatment layer 20, leaving the texture of the treatment layer 20 smooth and soft, so as to provide maximum comfort to the user.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of forming a treatment layer on a treatment brassiere having at least a breast support including an inner surface, comprising the steps of:

(a) melting a predetermined amount of non-absorptive treatment material to form a treatment solution; and (b) applying said treatment solution on the inner surface of said breast support such that said treatment solution integrally forms said treatment layer on the inner surface of said treatment brassiere such that said treatment layer forms as a treatment barrier between a breast surface of a user and the inner surface of said breast support for substantially keeping a breast treatment on said breast surface of said user.

2. The method as recited in claim 1, in step (b), further comprising the steps of:

(b.1) turning said treatment brassiere inside out that the inner surface of said breast support is exposed in a convex manner such that said treatment solution is evenly applied on the inner surface of said breast support;

(b.2) drying said treatment solution such that said treatment layer is integrally formed on the inner surface of said breast support; and (b.3) turning said breast support of said treatment brassiere back to an original shape such that said treatment layer has a curvature corresponding with a curvature of the inner surface of said breast support.

3. The method, as recited in claim 1, wherein said treatment layer is made of natural rubber such that said treatment layer is deformable with respect to said breast support for fittingly contacting said breast surface of said user.

4. The method, as recited in claim 2, wherein said treatment layer is made of natural rubber such that said treatment layer is deformable with respect to said breast support for fittingly contacting said breast surface of said user.

5. The method, as recited in claim 3, wherein said treatment layer is made of latex.

6. The method, as recited in claim 4, wherein said treatment layer is made of latex.

7. The method as recited in claim 1, after step (b), further comprising a step of applying a drying agent to said treatment layer to provide a smoother finish to said treatment layer on said treatment brassiere.

8. The method as recited in claim 2, after step (b), further comprising a step of applying a drying agent to said treatment layer to provide a smoother finish to said treatment layer on said treatment brassiere.

9. The method as recited in claim 6, after step (b), further comprising a step of applying a drying agent to said treatment layer to provide a smoother finish to said treatment layer on said treatment brassiere.

10. The method, as recited in claim 7, wherein said drying agent is talcum powder.

11. The method, as recited in claim 8, wherein said drying agent is talcum powder.

12. The method, as recited in claim 9, wherein said drying agent is talcum powder.

* * * * *